US005095593A

United States Patent [19]

Krauss

[11] Patent Number: 5,095,593

[45] Date of Patent: * Mar. 17, 1992

[54] LOCKING DEVICE WITH TWO MEMBERS FOR ATTACHING OBJECTS

[75] Inventor: Mark J. Krauss, Forest Hills, N.Y.

[73] Assignee: American Cord & Webbing Co., Woosocket, R.I.

[ * ] Notice: The portion of the term of this patent subsequent to Jan. 1, 2008 has been disclaimed.

[21] Appl. No.: 581,670

[22] Filed: Sep. 13, 1990

Related U.S. Application Data

[63] Continuation of Ser. No. 387,943, Jul. 31, 1989, Pat. No. 4,980,955.

[51] Int. Cl.[5] ..... A44B 11/25

[52] U.S. Cl. ..... 24/591; 403/348

[58] Field of Search ..... 292/218; 24/590, 591, 24/597, 687, 688, 694, 109; 411/549, 553; 403/348; 70/57.1

[56] References Cited

U.S. PATENT DOCUMENTS

| | | | |
|---|---|---|---|
| 1,084,408 | 1/1914 | Didierjean | 24/591 |
| 2,217,249 | 10/1940 | Flower | 24/591 |
| 2,423,432 | 7/1947 | Barlow | 411/549 X |
| 2,581,816 | 1/1952 | Schlueter | 70/100 |
| 2,648,882 | 8/1953 | Van Buren, Jr. | 24/109 |
| 3,742,741 | 7/1973 | Cahan | 70/63 |
| 3,802,233 | 4/1974 | Riley | 70/241 |
| 3,858,752 | 1/1975 | Marvin, Jr. et al. | 220/325 |
| 3,863,762 | 2/1975 | Arai | 292/218 X |
| 3,914,829 | 10/1975 | Paskert | 70/57.1 |
| 3,951,444 | 4/1976 | Shull | 292/359 |
| 4,052,093 | 10/1977 | Fattori | 292/218 |
| 4,391,461 | 7/1983 | Deibele | 292/204 |
| 4,627,249 | 12/1986 | Dumortier | 70/139 |
| 4,677,714 | 7/1987 | Wright | 411/549 X |
| 4,736,972 | 4/1988 | Mosch | 292/204 |
| 4,980,955 | 1/1991 | Krauss | 24/591 |

FOREIGN PATENT DOCUMENTS

| | | | |
|---|---|---|---|
| 233451 | 4/1911 | Fed. Rep. of Germany | 24/597 |
| 3622579 | 6/1987 | Fed. Rep. of Germany | 24/591 |
| 0475502 | 5/1915 | France | 24/597 |
| 1230996 | 5/1971 | United Kingdom | 24/591 |

*Primary Examiner*—Lloyd A. Gall

*Attorney, Agent, or Firm*—Kane, Dalsimer, Sullivan, Kurucz, Levy, Eisele & Richard

[57] ABSTRACT

A locking device for fastening and/or locking two objects or for securing a flexible fabric to surface, includes a first member which may be secured to the first object with a rotatable insert, and a second member secured to the second object. The second member includes projections for engaging arms of said insert upon rotation of said insert.

8 Claims, 4 Drawing Sheets

LOCKING DEVICE WITH TWO MEMBERS FOR ATTACHING OBJECTS

This is a continuation of copending application(s) Ser. No. 07/387,943 filed on Jul. 31, 1989 now U.S. Pat. No. 4,980,955.

BACKGROUND OF THE INVENTION a. Field of invention

This invention pertains to buckles and similar locking devices comprising two members constructed and arranged to interlock when mated thereby, to secure two objects to each other. More particularly, this invention pertains to a fastener or locking device which may be used to secure a relatively flexible first object to the surface of a second object.

b. Description of the Prior Art

In various applications it is frequently desirable to secure a relatively flexible object such as a sheet of fabric to the surface of a rigid object. The rigid object may be, for example, the enclosure for a pool or a hot tub, which must be shrouded in a fabric cover, the flexible object, when not in use, to protect the pool, to prevent unauthorized use thereof, etc. The fabric cover must be secured to the enclosure in a reliable manner so that it cannot be removed by an infant, and it will remain secure even under extreme weather conditions, such as for example strong winds. At the same time, the locking mechanism must be easy and quick to open and close for the convenience of the user. The most common locking mechanism involves providing one of the objects, for example the pool enclosure, with a hoop of fabric or other material, and providing the other object with a button, a buckle or similar rigid object so that the hoop can be passed over it to secure the cover. Of course, this type of locking device is easily opened by an infant. Furthermore, it is not resistant to strong weather conditions, and is prone to an early failure due to wear and tear.

OBJECTIVES AND SUMMARY OF THE INVENTION

In view of the above-mentioned disadvantages of the prior art, it is an objective of the present invention to provide a locking mechanism for securing or fastening two objects together in a reliable manner.

A further objective is to provide a locking device for securing two objects together which locking device is substantially child-proof.

Yet, another objective is to provide a locking device which can be made of inexpensive materials to reduce costs.

Other objectives and advantages of the invention shall become apparent from the following description of the invention. Briefly, a locking device constructed in accordance with this invention includes a first or upper member for securing to a first object, and having a cavity with a rotatable insert.

A second or lower member of the locking device is secured to the second object and has arms for selectively engaging said insert. The second member fits into said cavity as said first member is placed over the second member.

DETAILED DESCRIPTION OF THE INVENTION

It should be understood that in the following description, terms such as upper, lower, horizontal etc. are used merely for illustrative purposes.

Figure 1:
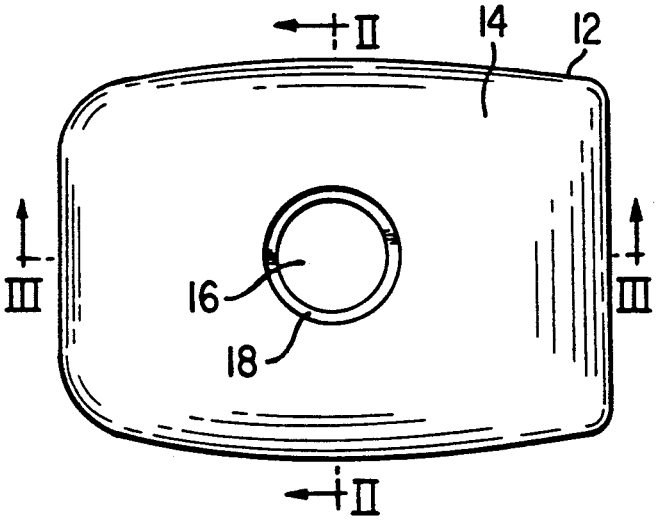
FIG. 1 shows a plane view of an upper member of a buckle for a locking, device constructed in accordance with this invention.
Figure 2:
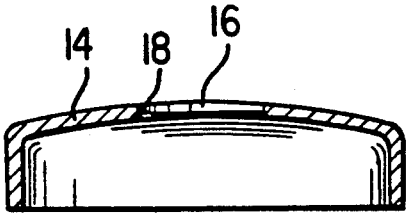
FIGS. 2 and 3 show side-sectional views of the member of FIG. 1.
Figure 3:
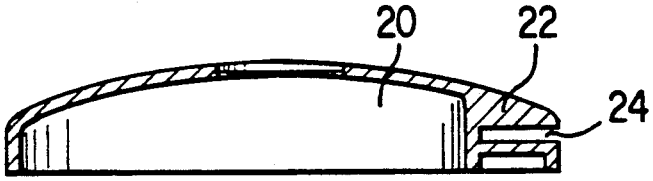
Figure 4:
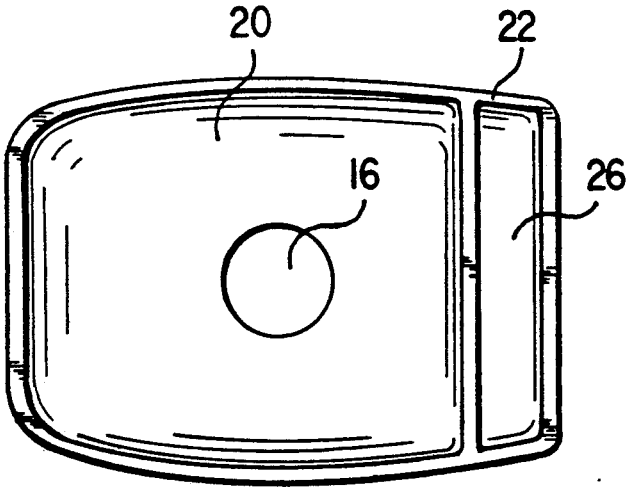
FIG. 4 shows a bottom view of the member of FIG. 1.
Figure 5:
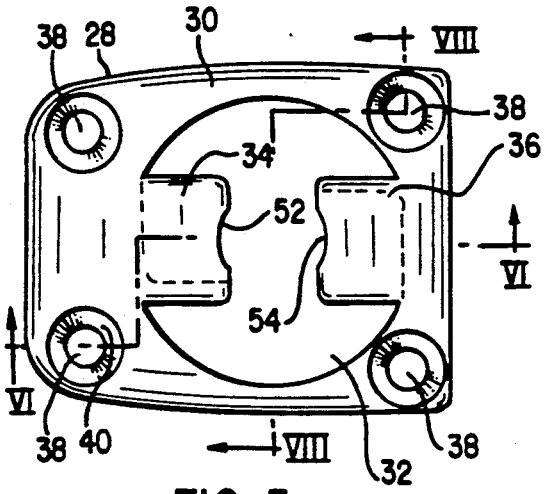
FIG. 5 shows a plane view of a lower member of the buckle.

Referring now to the drawings, a locking device constructed in accordance with this invention consists of two parts: a buckle and an insert. The buckle 10 has an upper member 12 shown in FIGS. 1–4 having a curved top wall 14. At the center of the top wall there is a circular hole 16 with an enlarged or countersunk mouth as at 18. As shown in FIGS. 2–4, the upper member 12 is almost completely hollow, having a cavity 20 except for a portion 22 disposed at one longitudinal side of the member 12. This portion 22 is provided with a horizontal slot 24. Portion 22 also has an indentation 26 substantially coextensive with slot 24.

Figure 7:
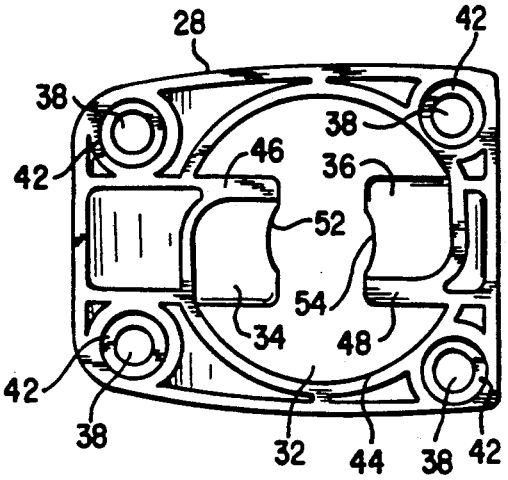
FIG. 7 shows a bottom view of the lower member of FIG. 5.
Figure 6:
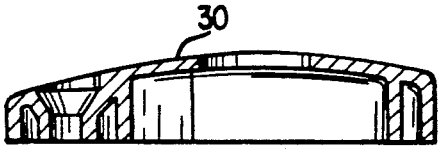
FIGS. 6 and 8 show side-sectional views of the lower member of FIG., 5.
Figure 8:
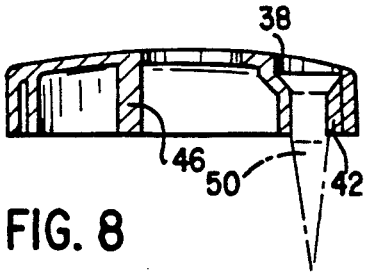
Figure 9:
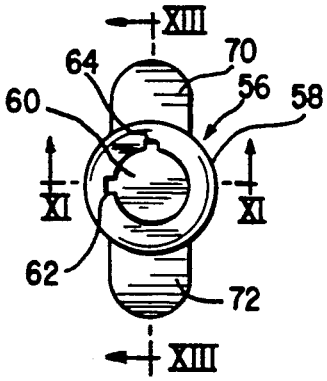
FIG. 9 shows a plane view of an insert for the locking device.
Figure 10:
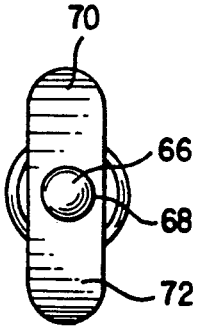
FIG. 10 shows a bottom view of the insert of FIG. 9.
Figure 13:
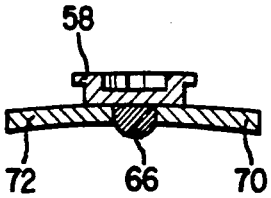
FIGS. 11 and 13 show side-sectional views of the insert of FIG. 9.
Figure 11:
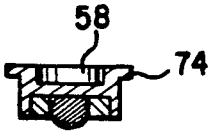
Figure 12:
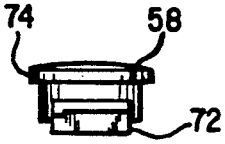

The buckle 10 also has a lower member 28 shown in detail in FIGS. 5–8. This member 28 is arranged and constructed to form an interference fit with upper member 12 when inserted into cavity 20. The member 28 includes a concave wall 30. At the center in wall 30, there is a large circular hole 32. The wall 30 also has two diametrically opposed horizontal sections 34, 36. A plurality of smaller holes 38 are provided at the four corners of the wall 30 as shown. The holes are countersunk as at 40. As best seen in FIG. 7, on the bottom, member 28 has a plurality of cylindrical bosses 42 corresponding to holes 38 for reinforcing the member. The member 28 is also provided with a substantially circular wall 44 following hole 32, except at one of the edges of sections 34, 36. As seen in FIG. 7, wall 44 has one wall portion 46 following one edge of section 34, while along section 36, wall 44 has a wall portion 48 diametrically opposite wall portion 46. Holes 38, with walls 42 and countersinks 40 cooperate to accept and hold screws, such as a wood screw 50, for securing the lower buckle member 28 to an object. Furthermore, each of the sections 34, 36 has a curved indentation as at 52, 54 concentric with hole 32.

The locking device further includes an insert 56, shown in detail in FIGS. 9-14. The insert includes a cup-shaped insert portion 58 with a concentric indentation 60. Two keyways 62, 64 are provided around the indentation, preferably spaced at an angle of about 90° as shown. A circular boss 66 is secured to the bottom of insert portion 58 extending downwardly. The boss is used to hold securely a paddle 68 with two arms 70, 72 extending diametrically away from the boss and curving slightly downwardly. The cup-shaped insert portion 58 also has an outer flange 74.

Figure 14:
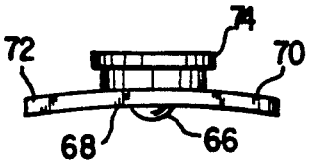
FIGS. 12 and 14 show side views of the insert of FIG. 9.
Figure 14A:
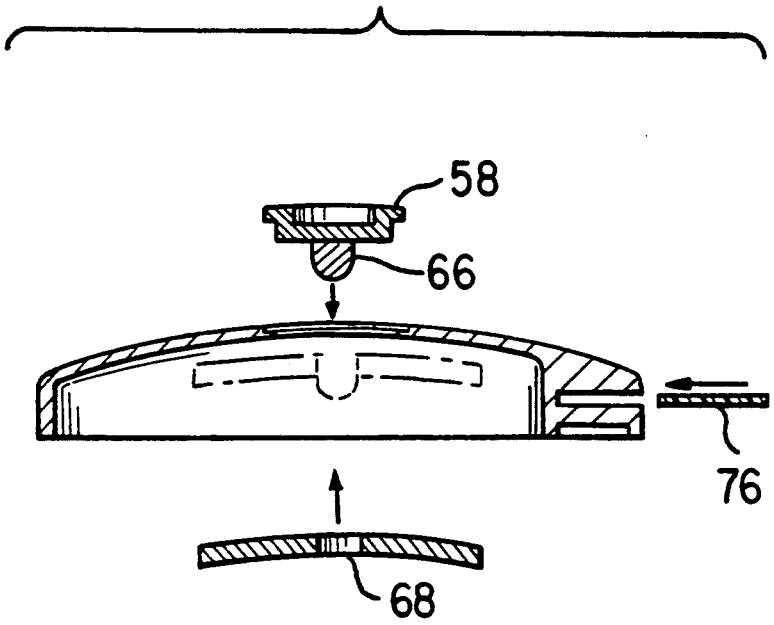
FIG. 14A shows how the insert of FIGS. 9–14 is mounted on an upper member.
Figure 15:
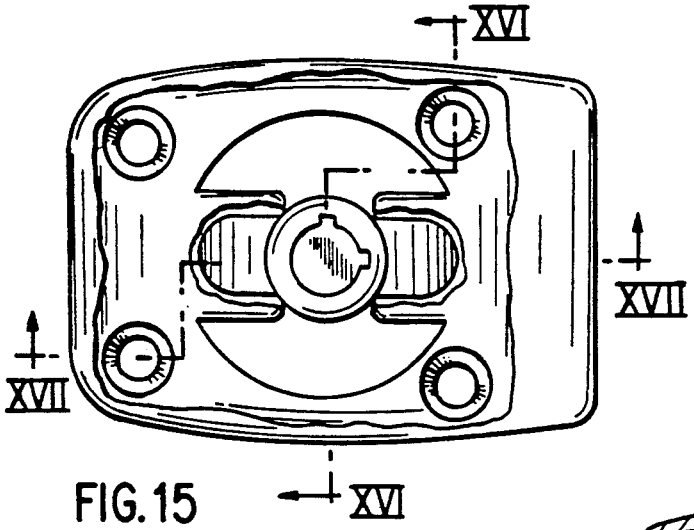
FIG. 15 shows the locking device with the paddle in the closed position, with part of the upper member broken away.
Figure 16:
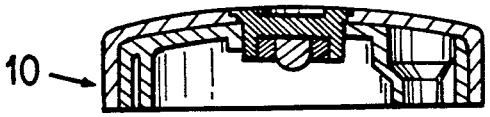
FIGS. 16 and 17 show side-sectional views of the locking device in the closed position.
Figure 17:
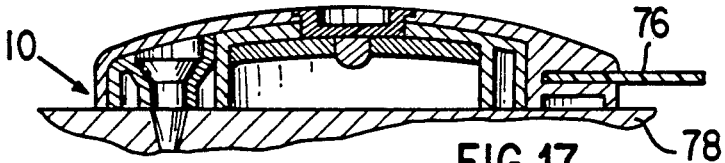

The insert 56 is attached to the buckle upper member 12 as follows (See FIG. 14A). Insert portion 58 is first placed into hole 16 with flange 74 resting on mouth 18. Paddle 68 is then inserted on boss 66 and is secured to insert portion 58 by gluing or other similar means. In this manner, the insert 56 is rotatably disposed in hole 16. Now, the locking device is ready for mounting. The upper member 12 of locking device 10 may be mounted in any known manner to a first object, which may be for example, a cover 76. For example, an edge of cover 76 may be inserted into horizontal slot 24 as shown in FIG. 14A. Member 12 then, may be secured to cover 76 by sewing, pressing, etc. Member 28 is secured to a second object 78, which may be a part of a hot tube enclosure, by inserting screws 50 through holes 38. Alternatively, member 28 may be seamed to the second object by other well-known means such as spikes with balls, rivets, etc., the exact seaming means depending on the nature of object 78.

Figure 18:
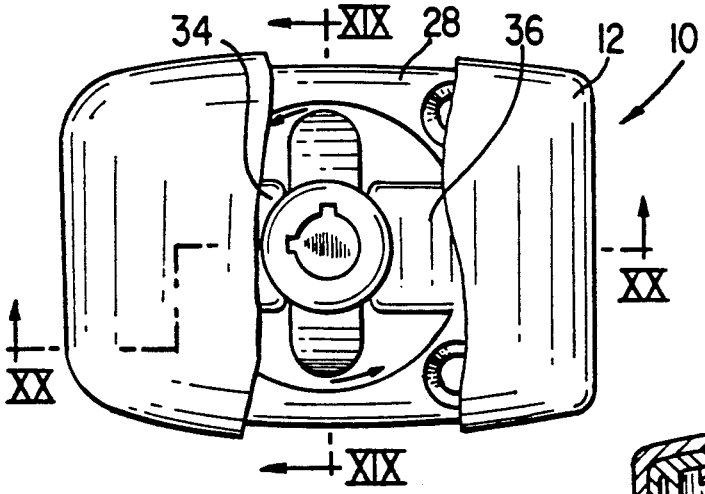
FIG. 18 shows the locking device in the open position, with part of the upper member broken away.
Figure 19:
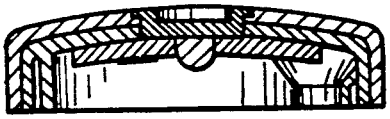
FIGS. 19 and 20 show side-sectional views of the locking device in the open position.
Figure 20:
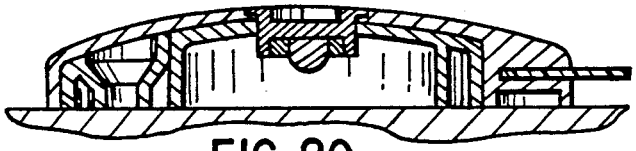

The first object (i.e. the cover) then may be fastened and/or secured to the second object (i.e. the enclosure) in two steps. First the upper member 12 of the buckle is snapped over the lower member 28. In this step the paddle 68 is positioned so that it may be inserted between the two sections 34, 36 as shown in FIG. 18. Once the upper member is positioned properly over the lower member (as shown in FIGS. 18-20), insert 56 is rotated by about 90° as shown in FIG. 18 forcing paddle 68 under the sections 34, 36. Preferably the members 12, 26 and insert 56 are dimensioned so that as the insert is turned an interference fit is formed between the paddle and the section 34, 36. The rotation of the paddle is stopped when the paddle comes into contact with wall sections 46, 48. The insert may be rotated for example with a specially shaped tool adapted to engage at least one of the keyways 62, 64. The keyways may also be used to indicate whether the paddle is in the opened or closed position.

In this manner the locking device can be used to firmly secure an object to another. The locking device can be opened and closed with relative ease, yet it will resist strong winds and is infant-proof.

Obviously numerous modifications may be made to the invention without departing from its scope as defined in the appended claims.

I claim:

1. A low profile locking device for securing a first object to a second object, said device comprising:

a first member including a first member top wall with a first member central opening, first member sidewall means disposed around said first member top wall and extending downwardly, said first member sidewall means cooperating with said first member top wall to form a cavity, and a first member securing slot for selectively securing said first member to said first object;

a second member including a second member top wall with a second member central opening larger than said first member opening and two opposed horizontal sections with bottom surfaces extending into said second member central opening, second member sidewall means disposed around said second member top wall and extending downwardly, said second member sidewall means cooperating with said second member top wall to fit snugly in said cavity, and a second member securing hole for selectively securing said second member to said second object; and an insert having an insert portion rotatably captured in said first member central opening, a boss secured to and extending downwardly from said insert portion, and two opposed arms extending radially from said boss, said boss and arms being arranged and constructed to selectively interlock said first and second members when said second member is inserted into said cavity with said insert being rotated to engage said opposed horizontal sections by rotating said arms to a position below said bottom surfaces.

2. The locking device of claim 1 wherein said second member central opening is circular and said horizontal sections are substantially rectangular.

3. The locking device of claim 1 wherein said first member top wall, second member top wall and arms are substantially in parallel when said second member is inserted into said cavity.

4. The locking device of claim 1 wherein said horizontal sections each have a wall section extending downwardly from said bottom surface to form stops for said arms.

5. The locking device of claim 1 wherein said second member sidewall means define a second member cavity for housing said arms while said members are interlocked.

6. The locking device of claim 1 wherein said first member securing slot is disposed in one of said first member top wall and said first member sidewall means.

7. The locking device of claim 1 wherein said second member securing hole is disposed in one of said second member top wall and said second member sidewall means.

8. The locking device of claim 1 wherein said second member fits completely in said cavity.

* * * * *